US005619836A

United States Patent [19]

Rouch et al.

[11] Patent Number: 5,619,836

[45] Date of Patent: Apr. 15, 1997

[54] SHEETROCK PATCH FASTENER DEVICE AND METHOD FOR UTILIZING

[76] Inventors: Duane A. Rouch, c/o Andrews 176 Daly Rd.; Mark S. Andrews, 176 Daly Rd., both of East Northport, N.Y. 11731

[21] Appl. No.: 505,681

[22] Filed: Jul. 21, 1995

[51] Int. Cl.[6] ..... E04B 1/38; E04G 23/02

[52] U.S. Cl. ..... 52/715; 52/514.5; 52/741.41; 52/DIG. 6; 411/458; 411/466

[58] Field of Search ..... 52/514, 514.5, 52/741.41, 765, 489.2, 715, DIG. 6; 411/458, 459, 460, 466

[56] References Cited

U.S. PATENT DOCUMENTS

| | | | |
|---|---|---|---|
| 1,974,819 | 9/1934 | Koerner | 52/765 |
| 2,065,525 | 12/1936 | Hamilton | 411/460 |
| 2,084,544 | 6/1937 | Wilson | 52/715 |
| 2,638,774 | 5/1953 | Wieman | 52/514 |
| 2,913,042 | 11/1959 | Taylor | 411/460 |
| 3,717,970 | 2/1973 | Rosenblum | 52/54 |
| 3,995,404 | 12/1976 | Thaw et al. | 52/514 |
| 4,178,730 | 12/1979 | Rowinski | 52/514 |
| 4,373,313 | 2/1983 | Nash, Jr. | 52/204.591 |
| 4,460,420 | 7/1984 | Estrada | 156/64 |
| 4,464,821 | 8/1984 | Haytayan | 411/466 |
| 4,641,474 | 2/1987 | Cannarsa | 52/514 |
| 4,782,642 | 11/1988 | Conville | 52/770 |
| 4,862,667 | 9/1989 | Melland | 52/731.5 |
| 4,995,605 | 2/1991 | Conville | 52/770 |
| 5,269,861 | 12/1993 | Gilbreath | 156/98 |
| 5,299,404 | 4/1994 | Jabro | 52/514 |

*Primary Examiner*—Michael Safavi
*Attorney, Agent, or Firm*—Richard L. Miller

[57] ABSTRACT

A sheetrock patch fastener that includes an integrally formed unit that is capable of supporting repair patches of various sizes and which is non-intrusive to the hidden surface of the sheetrock wall being repaired. The sheetrock patch fastener includes an upper portion, an intermediate portion, and a lower portion. The upper portion has an upper portion distal edge, an upper portion proximal edge, and a pair of upper portion distal edge corner teeth which extend downwardly from the upper portion at the ends of the upper portion distal edge. The intermediate portion extends downwardly from the upper portion and has an intermediate portion upper edge that is collinear with the upper portion proximal edge, and an intermediate portion lower edge. The lower portion extends outwardly from the intermediate portion in a direction opposite to that of the upper portion and has a lower portion proximal edge that is collinear with the intermediate portion lower edge, a lower portion distal edge, and a pair of lower portion distal edge corner teeth that extend upwardly from the lower portion at the ends of the lower portion distal edge.

11 Claims, 1 Drawing Sheet

FIG.1
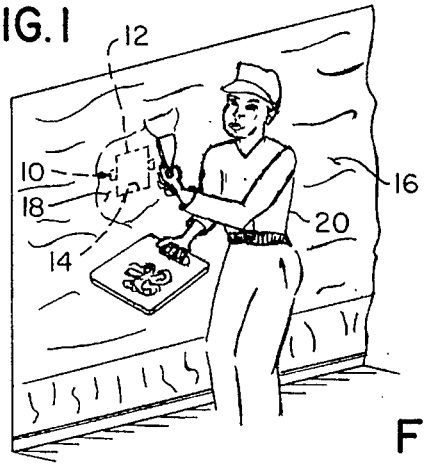
FIG.5
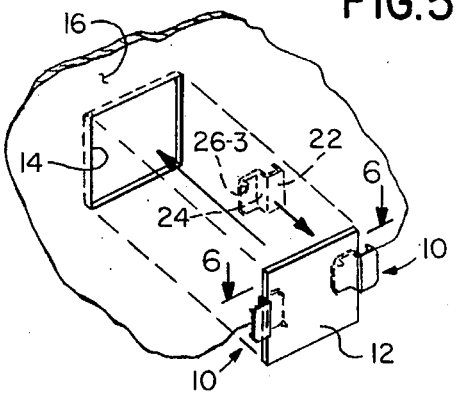
FIG.4
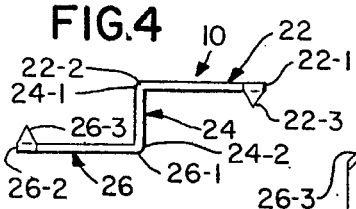
FIG.7
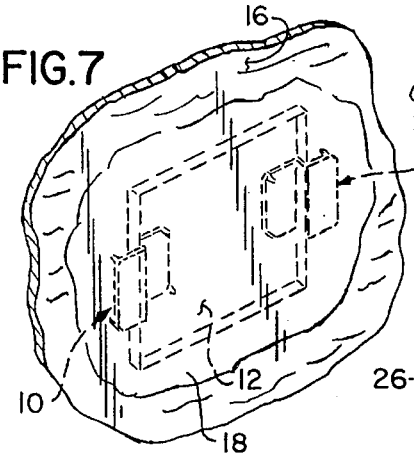
FIG.3
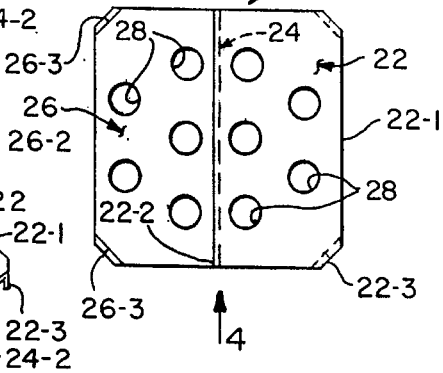
FIG.2
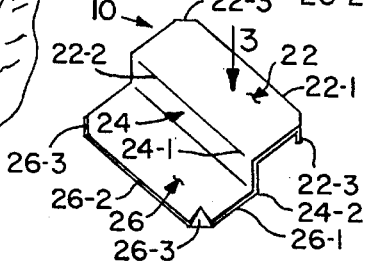
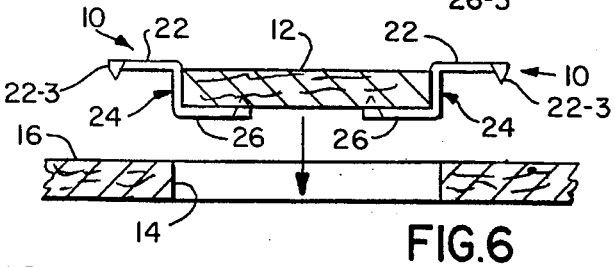
FIG.6
FIG.8
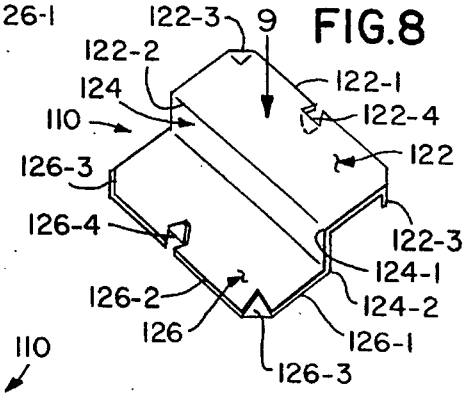
FIG.9
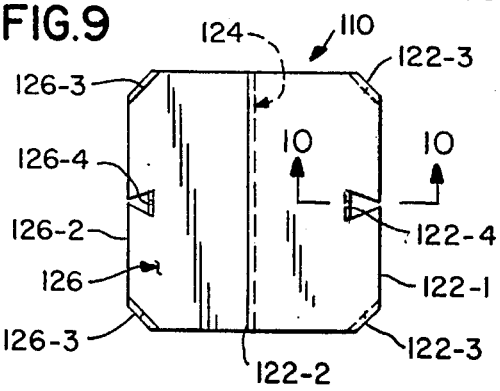
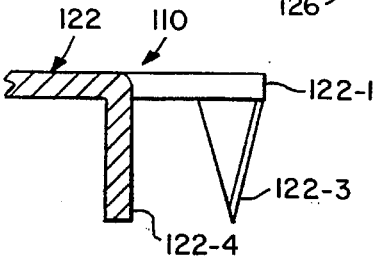
FIG.10

SHEETROCK PATCH FASTENER DEVICE AND METHOD FOR UTILIZING

BACKGROUND OF THE INVENTION

The present invention relates to a sheetrock repair fastener. More particularly, the present invention relates to a sheetrock repair fastener that includes an integrally formed unit that is capable of supporting repair patches of various sizes and which is non-intrusive to the hidden surface of the sheetrock being repaired.

In the late 1940's the use of gypsum board panels, typically referred to as "sheetrock" or "drywall", became the preferred building material for interior walls and partitions in most types of buildings in the United States, primarily because of the relatively low cost of material and installation. These panels are essentially made of hardened plaster-like gypsum material which is sandwiched between sheets of paper or cardboard material. Sheetrock panels, which can be cut to size using only a utility knife, are typically nailed or screwed to spaced studs or joists to provide a flat wall or ceiling surface which spans these supporting members, leaving the space between the studs or joists hollow behind the wall surface.

However, a primary drawback to using sheetrock material is that it is easily damaged by a sudden blow applied to an area, such as a blow caused by the protruding door knob of a swinging door. The material is also susceptible to being punched by sharp objects. Also, removal or relocation of an electrical outlet or switch box during remodeling may leave a hole that must be filled or covered.

A variety of techniques and articles have been developed for repairing holes and cracks in gypsum wallboard. One well known method involves simply filling the hole with a backing of paper, rags or wire mesh and overlaying the backing with a patching compound. This method is generally undesirable because it is difficult to hold the backing material in place during repair operations. Moreover, the repaired portion of the wall usually remains structurally weaker than the undamaged wall portion. Another method involves cutting out the damaged section of the wall and replacing it with a sheetrock patch.

Numerous innovations for sheetrock repair have been provided in the prior art that will be described. However, even though these innovations may be suitable for the specific individual purposes to which they address, they differ from the present invention in that they do not teach a sheetrock repair fastener that includes an integrally formed unit that is capable of supporting repair patches of various sizes and which is non-intrusive to the hidden surface of the sheetrock being repaired.

For example, U.S. Pat. No. 3,717,970 to Rosenblum teaches a device that provides support for a patching material for a drywall. The device includes two slidably connected pieces that can be locked together to form a flat, and a recessed backing support that is inserted into a trimmed hole in the drywall.

Another example, U.S. Pat. No. 4,460,4290 to Estrada teaches a wallboard repair article that includes a substantially rigid steel plate that has integral teeth forcibly insertable into the wallboard to hold the article in place over the damaged area. A flexible cover portion formed of wallboard facing paper overlaps the edges of the plate and is bonded thereto.

Still another example, U.S. Pat. No. 4,782,642 to Conville teaches a drywall repair clip that is placed over the edge of the damaged sheetrock with a portion extending along the hidden surface of the damaged sheetrock which risks damage to insulation, plumbing, electrically lines, and any and all other elements contained within the wall. A pair of tabs extend along the outer surface of the sheetrock and temporarily secure the clip to the sheetrock. The clip must first be secured to the damaged sheetrock by a screw precisely positioned ¾ inch from the edge of the damaged sheetrock. If the screw does not go into the clip easily, pressure must be applied to the screw risking damage to the sheetrock. The sheetrock patch is placed in the hole of the damaged sheetrock and secured to the clip by another screw which again can cause damage to the sheetrock. The tabs must then snapped off by a redundant back and forth motion.

Yet another example, U.S. Pat. No. 5,269,861 to Gilbreath teaches a method for repairing sheetrock walls that utilizes fabric strips impregnated with an inactivated fast-setting cementitious material or plaster, like that used in plaster casts for immobilizing broken bones, and a water-based glue.

Finally, another example, U.S. Pat. No. 5,299,404 to Jabro teaches a patch for hollow doors and walls that includes a backing plate of a stiff material. The backing plate is of a size that can be inserted into the hole and yet be sufficiently large enough to be positioned flat against the back surface of the wall and cover substantially the entire area of the hole. The positioned backing plate forms a front recessed pocket to receive a suitable filler material.

It is apparent that numerous innovations for sheetrock repair have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a sheetrock patch fastener that avoids the disadvantages of the prior art.

Another object of the present invention is to provide a sheetrock patch fastener that is simple and inexpensive to manufacture.

Still another object of the present invention is to provide a sheetrock patch fastener that is simple and easy to use.

Yet another object of the present invention is to provide a sheetrock patch fastener that is integrally formed.

Still yet another object of the present invention is to provide a sheetrock patch fastener that is capable of supporting repair patches of various sizes without the use of screws.

Yet still another object of the present invention is to provide a sheetrock patch fastener that is non-intrusive to the hidden surface of the sheetrock being repaired.

Still yet another object of the present invention is to provide a sheetrock patch fastener that will not damage the contents of the wall being repaired, such as, insulation, plumbing, electrically lines, and any and all other elements contained within the wall.

Yet still another object of the present invention is to provide a sheetrock patch fastener that includes an upper portion, an intermediate portion, and a lower portion.

Still yet another object of the present invention is to provide a sheetrock patch fastener wherein the upper portion has an upper portion distal edge, an upper portion proximal edge, and a pair of upper portion distal edge corner teeth which extend downwardly from the upper portion at the ends of the upper portion distal edge.

Yet still another object of the present invention is to provide a sheetrock patch fastener wherein the intermediate portion extends downwardly from the upper portion and has an intermediate portion upper edge that is collinear with the upper portion proximal edge, and an intermediate portion lower edge.

Still yet another object of the present invention is to provide a sheetrock patch fastener wherein the lower portion extends outwardly from the intermediate portion in a direction opposite to that of the upper portion and has a lower portion proximal edge that is collinear with the intermediate portion lower edge, a lower portion distal edge, and a pair of lower portion distal edge corner teeth that extend upwardly from the lower portion at the ends of the lower portion distal edge so that a patch of any size can be held in a hole in a sheetrock wall.

Yet still another object of the present invention is to provide a sheetrock patch fastener wherein the upper portion, the pair of upper portion distal edge corner teeth, the intermediate portion, the lower portion, and the pair of lower portion distal edge corner teeth are integrally formed.

Still yet another object of the present invention is to provide a sheetrock patch fastener wherein the upper portion, the intermediate portion, and the lower portion are flat.

Yet still another object of the present invention is to provide a sheetrock patch fastener wherein the upper portion, the pair of upper portion distal edge teeth, the intermediate portion, the lower portion, and the pair of lower portion distal edge corner teeth are manufactured from a thin sheet material selected from a group consisting of sheet metal, typically but not limited to aluminum, and galvanized steel.

Still yet another object of the present invention is to provide a sheetrock patch fastener wherein the upper portion, the pair of upper portion distal edge teeth, the intermediate portion, the lower portion, and the pair of lower portion distal edge teeth are formed by stamping and bending.

Yet still another object of the present invention is to provide a sheetrock patch fastener wherein the intermediate portion is substantially perpendicular to the upper portion.

Still yet another object of the present invention is to provide a sheetrock patch fastener wherein the lower portion is substantially perpendicular to the intermediate portion.

Yet still another object of the present invention is to provide a sheetrock patch fastener wherein the pair of upper portion distal edge corner teeth are formed by the downward bending of the corners of the upper portion.

Still yet another object of the present invention is to provide a sheetrock patch fastener wherein the pair of lower portion distal edge corner teeth are formed by the upward bending of the corners of the lower portion.

Yet still another object of the present invention is to provide a sheetrock patch fastener that further includes at least one upper portion distal edge intermediate tooth disposed intermediate the pair of upper portion distal edge corner teeth.

Finally, another object of the present invention is to provide a sheetrock patch fastener that further includes at least one lower portion distal edge intermediate tooth disposed intermediate the pair of lower portion distal edge corner teeth.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view illustrating a workman utilizing the instant invention for patching a wall;

FIG. 2 is a diagrammatic perspective view of the preferred embodiment of the instant invention;

FIG. 3 is an enlarged elevational view taken in the direction of arrow 3 in FIG. 2, of an embodiment having optional joint compound adhering apertures;

FIG. 4 is an edge view taken in the direction of arrow 4 in FIG. 3;

FIG. 5 is a diagrammatic exploded perspective view illustrating the invention in grater detail being used to patch a wall;

FIG. 6 is a cross sectional view taken along line 6—6 in FIG. 5;

FIG. 7 is a diagrammatic perspective view of a typical wall incorporating the instant invention affixing a patch therein;

FIG. 8 is a diagrammatic perspective view of an alternate embodiment of the instant invention per se;

FIG. 9 is an elevational view taken in the direction of arrow 9 in FIG. 8; and FIG. 10 is an enlarged cross sectional view taken along line 10—10 of FIG. 9, with parts broken away.

LIST OF REFERENCE NUMERALS UTILIZED IN THE DRAWING

Preferred Embodiment

10 sheetrock patch fastener of the present invention
12 patch
14 hole
16 sheetrock wall
18 joint compound
20 user
22 upper portion
22-1 upper portion distal edge
22-2 upper portion proximal edge
22-3 pair of upper portion distal edge corner teeth
24 intermediate portion
24-1 intermediate portion upper edge
24-2 intermediate portion lower edge
26 lower portion
26-1 lower portion proximal edge
26-2 lower portion distal edge
26-3 pair of lower portion distal edge corner teeth
28-joint compound adhering apertures Alternate Embodiment

110 sheetrock patch fastener of the present invention

122 upper portion

122-1 upper portion distal edge

122-2 upper portion proximal edge

122-3 pair of upper portion distal edge corner teeth

122-4 upper portion distal edge intermediate tooth

124 intermediate portion

124-1 intermediate portion upper edge

124-2 intermediate portion lower edge

126 lower portion

126-1 lower portion proximal edge

126-2 lower portion distal edge

126-3 pair of lower portion distal edge corner teeth

126-4 lower portion distal edge intermediate tooth

DETAILED DESCRIPTION OF THE PREFERRED EMBODIMENT

Referring now to the figures in which like numerals indicate like parts, and particularly to FIG. 1, the sheetrock patch fastener of the present invention is shown generally at 10, supporting a patch 12 in a hole 14 of a sheetrock wall 16, that is concealed by joint compound 18 being applied by a user 20.

The configuration of the sheetrock patch fastener 10 can best be seen in FIGS. 2–4, and as such, will be discussed with reference thereto.

The sheetrock patch fastener 10 is an integrally formed unit that can be stamped and bent from a substantially flat sheet material, such as, sheet metal, aluminum, galvanized steel, but is not limited to that.

The sheetrock patch fastener 10 includes an upper portion 22 that is substantially flat and has an upper portion distal edge 22-1, an upper portion proximal edge 22-2, and a pair of upper portion distal edge corner teeth 22-3 which extend downwardly from the upper portion 22 at the ends of the upper portion distal edge 22-1.

The pair of upper portion distal edge corner teeth 22-3 can be formed by the downward bending of the corners of the upper portion 22 at the upper portion distal edge 22-1, but is not limited to that.

An intermediate portion 24 is substantially flat and extends downwardly, approximately 90 degrees, from the upper portion 22. The intermediate portion 24 has an intermediate portion upper edge 24-1 that is collinear with the upper portion proximal edge 22-2, and an intermediate portion lower edge 24-2.

A lower portion 26 is substantially flat and extends outwardly, approximately 90 degrees, from the intermediate portion 24, in a direction opposite to that of the upper portion 22. The lower portion 26 has a lower portion proximal edge 26-1 that is collinear with the intermediate portion lower edge 24-2, a lower portion distal edge 26-2, and a pair of lower portion distal edge corner teeth 26-3 which extend upwardly from the lower portion 26 at the ends of the lower portion distal edge 26-2.

The pair of lower portion distal edge corner teeth 26-3 can be formed by the upward bending of the corners of the lower portion 26 at the lower portion distal edge 26-2, but is not limited to that.

As shown in FIG. 3, the sheetrock patch fastener 10 may contain optional joint compound adhering apertures 28 to facilitate the adhesion of the joint compound 18 to the instant invention.

The utilization of the sheetrock patch fastener 10 can best be seen in FIGS. 5–7, and as such, will be discussed with reference thereto.

Initially, as can be seen in FIG. 5, each sheetrock patch fastener 10 is first snugly positioned on the patch 12 with the lower portions 26 disposed behind the patch 12 and the intermediate portions 24 disposed adjacent to the sides of the patch 12.

Once properly positioned, pressure is applied to the lower portions 26 causing each of the pair of lower portion distal edge corner teeth 26-3 to enter the patch 12 and affix the sheetrock patch fasteners 10 thereto.

Subsequently, after the sheetrock patch fasteners 10 are snugly positioned on the patch 12, as shown in FIG. 6, the patch 12 with the sheetrock patch fasteners 10 affixed thereto is snugly positioned in the hole 14 of the sheetrock wall 16 with the lower portions 26 disposed within the confines of the hole 14, the intermediate portions 24 disposed adjacent to the side of the hole 14, and the upper portions 22 disposed on the front of the sheetrock wall 16.

Once properly positioned, pressure is applied to the upper portions 22 causing each of the pair of upper portion distal edge corner teeth 22-3 to enter the sheetrock wall 16 and affix the sheetrock patch fasteners 10 and the patch 12 thereto.

Since the material of the sheetrock wall 16 is substantially compressible, and the upper portion 22 is manufactured from a substantially thin flat material, when the pressure is applied to the upper portion 22, the upper portion 22 will become recessed in the sheetrock wall 16 which will facilitate the finishing operation.

Subsequently, after the patch 12 with the sheetrock patch fasteners 10 affixed thereto is snugly positioned in the hole 14 of the sheetrock wall 16, as shown in FIG. 7, the joint compound 18 is applied over the patch 12 and the sheetrock patch fasteners 10 and the surrounding area of the sheetrock wall 16 until a smooth cosmetic appearance is achieved.

The configuration of an alternate embodiment of the sheetrock patch fastener 110 can best be seen in FIGS. 8–10, and as such, will be discussed with reference thereto.

The sheetrock patch fastener 110 is an integrally formed unit that can be stamped and bent from a substantially flat sheet material, such as, sheet metal, aluminum, galvanized steel, but is not limited to that.

The sheetrock patch fastener 110 includes an upper portion 122 that is substantially flat and has an upper portion distal edge 122-1, an upper portion proximal edge 122-2, a pair of upper portion distal edge cornet teeth 122-3 which extend downwardly from the upper portion 125 at the ends of the upper portion distal edge 122-1, and an upper portion distal edge intermediate tooth 122-4 which also extends downwardly from the upper portion 122 at the upper portion distal edge 122-1.

The pair of upper portion distal edge corner teeth 122-3 can be formed by the downward bending of the corners of the upper portion 122 at the ends of the upper portion distal edge 122-1, but is not limited to that. The upper portion distal edge intermediate tooth 122-4 can be formed by stamping out and downwardly bending a part of the upper portion 122 at the upper portion distal edge 122-1, but is not limited to that.

An intermediate portion 124 is substantially flat and extends downwardly, approximately 90 degrees, from the upper portion 122. The intermediate portion 124 has an intermediate portion upper edge 124-1 that is collinear with the upper portion proximal edge 122-2, and an intermediate portion lower edge 124-2.

A lower portion 126 is substantially flat and extends outwardly, approximately 90 degrees, from the intermediate portion 124, in a direction opposite to that of the upper portion 122. The lower portion 126 has a lower portion proximal edge 126-1 that is collinear with the intermediate portion lower edge 124-2, a lower portion distal edge 126-2, a pair of lower portion distal edge corner teeth 126-3 which extend upwardly from the lower portion 126 at the ends of the lower portion distal edge 126-2, and a lower portion distal edge intermediate tooth 126-4 which also extends upwardly from the lower portion 126 at the lower portion distal edge 126-2.

The pair of lower portion distal edge corner teeth 126-3 can be formed by the upward bending of the corners of the lower portion 126 at the lower portion distal edge 126-2, but is not limited to that. The lower portion distal edge intermediate tooth 126-4 can be formed by stamping out and upwardly bending a part of the lower portion 126 at the lower portion distal edge 126-2.

The utilization of the sheetrock patch fastener 110 is identical to that of the sheetrock patch fastener 10 except that when the pressure is applied to the lower portion 126, the lower portion distal edge intermediate tooth 126-4 in addition to the pair of lower portion distal edge corner teeth 126-3 will enter the patch 12 and when the pressure is applied to the upper portion 122, the upper portion distal edge intermediate tooth 122-4 in addition to the pair of upper portion distal edge teeth 122-3 will enter the sheetrock wall 16.

It will be understood that each of the elements described above, or two or more together, may also find a useful application in other types of constructions differing from the types described above.

While the invention has been illustrated and described as embodied in a sheetrock patch fastener, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A sheetrock patch fastener that holds a sheetrock patch having a back surface and an end wall in a hole of a sheetrock wall having a front surface without damaging anything within the sheetrock wall and without invading the end wall of the sheetrock patch wherein the hole in the sheetrock wall is defined by a wall, comprising:

a) a flat and rectangular-shaped wall portion abutable against the front surface of the sheetrock wall and having a proximal edge with ends, a distal edge being parallel to said proximal edge of said flat and rectangular-shaped wall portion and having ends, and a pair of parallel lateral edges; each edge of said pair of parallel lateral edges of said flat and rectangular-shaped wall portion extending perpendicularly from an end of said ends of said proximal edge of said flat and rectangular-shaped wall portion to a respective end of said ends of said distal edge of said flat and rectangular-shaped wall portion and forming therewith square corners both of which being bent perpendicularly upwardly forming triangular-shaped corner teeth being engagable with the front surface of the sheetrock wall, so that said flat and rectangular-shaped wall portion can be easily secured to the front surface of the sheetrock wall by merely pressing on said flat and rectangular-shaped wall portion and causing said triangular-shaped corner teeth of said flat and rectangular-shaped wall portion to pierce the front surface of the sheetrock wall and enter the sheetrock wall;

b) a flat and rectangular-shaped joint portion having an uppermost edge and a lowermost edge being parallel to said uppermost edge of said flat and rectangular-shaped joint portion; said flat and rectangular-shaped joint portion extending perpendicularly upwardly from said flat and rectangular-shaped wall portion with said lowermost edge of said flat and rectangular-shaped joint portion being coincident with said proximal edge of said flat and rectangular-shaped wall portion; said flat and rectangular-shaped joint portion having opposing faces abutable against, without invading, the end wall of the sheetrock patch and the wall defining the hole in the sheetrock wall, so that no damage is done to the end wall of the sheetrock patch and the wall defining the hole in the sheetrock wall, and c) a flat and rectangular-shaped patch portion abutable against the back surface of the sheetrock patch and having a proximal edge with ends and a distal edge being parallel to said proximal edge of said flat and rectangular-shaped patch portion and having ends; said flat and rectangular-shaped patch portion extending perpendicularly outwardly from said flat and rectangular-shaped joint portion in a direction opposite to that of said flat and rectangular-shaped wall portion and with said proximal edge of said flat and rectangular shaped patch portion being coincident with said uppermost edge of said flat and rectangular-shaped joint portion; said flat and rectangular-shaped patch portion further having a pair of parallel lateral edges; each edge of said pair of parallel lateral edges of said flat and rectangular-shaped patch portion extending perpendicularly from an end of said ends of said proximal edge of said flat and rectangular-shaped patch portion to a respective end of said ends of said distal edge of said flat and rectangular-shaped patch portion and forming therewith square corners both of which being bent perpendicularly downwardly forming triangular-shaped corner teeth being engagable with the back surface of the sheetrock patch, so that said flat and rectangular-shaped patch portion can be easily secured to the back surface of the sheetrock patch by merely pressing on said flat and rectangular-shaped patch portion and causing said triangular-shaped corner teeth of said flat and rectangular-shaped patch portion to pierce the back surface of the sheetrock patch and enter the sheetrock patch with said flat and rectangular-shaped patch portion not damaging any contents within the sheetrock wall.

2. The patch fastener as defined in claim 1, wherein said flat and rectangular-shaped wall portion, said flat and rectangular-shaped joint portion, and said flat and rectangular-shaped patch portion are integrally formed.

3. The fastener as defined in claim 2, wherein said flat and rectangular-shaped wall portion, said flat and rectangular-shaped joint portion, and said flat and rectangular-shaped patch portion are one of sheet metal, aluminum, and galvanized steel.

4. The fastener as defined in claim 3, wherein said flat and rectangular-shaped wall portion, said flat and rectangular-shaped joint portion, and said flat and rectangular-shaped patch portion are stamped and bent.

5. The fastener as defined in claim 1; further comprising a triangular-shaped intermediate tooth that is integrally formed with, and extends perpendicularly upwardly from, said distal edge of said flat and rectangular-shaped wall portion and is disposed equidistant between said triangular-shaped corner teeth of said flat and rectangular-shaped wall portion and is engagable with the front surface of the sheetrock wall, so that said flat and rectangular-shaped wall portion can be easily further secured to the front surface of the sheetrock wall by merely pressing on said flat and rectangular-shaped wall portion and causing said triangular-shaped intermediate tooth of said flat and rectangular-shaped wall portion to pierce the front surface of the sheetrock wall and enter the sheetrock wall.

6. The fastener as defined in claim 1; further comprising a triangular-shaped intermediate tooth that is integrally formed with, and extends perpendicularly downwardly from, said distal edge of said flat and rectangular-shaped patch portion and is disposed equidistant between said triangular-shaped corner teeth of said flat and rectangular-shaped patch portion and is engagable with the back surface of the sheetrock path, so that said flat and rectangular-shaped patch portion can be easily further secured to the back surface of the sheetrock patch by merely pressing on said flat and rectangular-shaped patch portion and causing said triangular-shaped intermediate tooth of said flat and rectangular-shaped patch portion to pierce the back surface of the sheetrock patch and enter the sheetrock patch.

7. The fastener as defined in claim 1, wherein at least one of said flat and rectangular-shaped wall portion and said flat and rectangular-shaped patch portion has a plurality of joint compound adhering throughbores that extend vertically therethrough, so that applied joint compound can be better adhered.

8. The fastener as defined in claim 5, wherein said flat and rectangular-shaped wall portion has a plurality of joint compound adhering throughbores that extend vertically therethrough, so that applied joint compound can be better adhered.

9. The fastener as defined in claim 6, wherein said flat and rectangular-shaped patch portion has a plurality of joint compound adhering throughbores that extend vertically therethrough, so that applied joint compound can be better adhered.

10. A method of fusing a sheetrock patch fastener to hold a sheetrock patch having a back surface and an end wall in a hole of a sheetrock wall having a front surface without damaging anything within the sheetrock wall, comprising the steps of:

a) removing a damaged area in the sheetrock wall forming the hole having a configuration, a size, and defined by a wall;

b) cutting the sheetrock patch to the size and configuration of the hole in the sheetrock wall;

c) placing a flat and rectangular-shaped patch portion of said sheetrock patch fastener on the back surface of the sheetrock patch with a flat and rectangular-shaped joint portion of said sheetrock patch fastener extending perpendicularly forwardly from said flat and rectangular-shaped patch portion and having a face of opposing faces abutting against the end wall of the sheetrock patch;

d) applying pressure to said rectangular-shaped patch portion;

e) causing triangular-shaped patch corner teeth, formed by perpendicularly forwardly bent square corners at points of intersection of each edge of a pair parallel of lateral edges of said flat and rectangular-shaped patch portion and a respective end of ends of a distal edge of said flat and rectangular-shaped patch portion, to pierce the back surface of the sheetrock patch and engage the sheetrock patch, so that said flat and rectangular-shaped patch portion is easily secured to the back surface of the sheetrock patch;

f) repeating steps c) through e) on the end wall of the sheetrock patch with an amount of said sheetrock rock patch fastener as necessary, depending upon the size and configuration of the hole in the sheetrock wall;

g) placing the sheetrock patch in the hole in the sheetrock wall with another face of said opposing faces of said flat and rectangular-shaped joint portion abutting against the wall defining the hole in the sheetrock wall and with a flat and rectangular-shaped wall portion of said sheetrock patch fastener extending perpendicularly sidewardly from said flat and rectangular-shaped joint portion, in a direction opposite to that of said flat and rectangularly-shaped patch portion, and being on the front surface of the sheetrock wall;

h) applying pressure to said rectangular-shaped wall portion;

i) causing triangular-shaped wall corner teeth, formed by perpendicularly rearwardly bent square corners at points of intersection of each edge of a pair of parallel lateral edges of said flat and rectangular-shaped wall portion and a respective end of ends of a distal edge of said flat and rectangular-shaped wall portion, to pierce the front surface of the sheetrock wall and engage the sheetrock wall, so that said flat and rectangular-shaped wall portion is easily secured to the front surface of the sheetrock wall; and j) repeating steps h) and i) depending upon the amount of said sheetrock rock patch fastener used, so that the sheetrock patch is secured in the hole in the sheetrock wall and said flat and rectangular-shaped patch portion protects anything in the sheetrock wall due to damage from said triangular-shaped corner teeth extending perpendicularly forwardly therefrom.

11. The method as defined in claim 10; further comprising the step of applying joint Compound over the sheetrock patch, said sheetrock patch fasteners, and the sheetrock wall until a smooth cosmetic appearance is achieved.

* * * * *